US005257567A

United States Patent [19]

Walker et al.

[11] Patent Number: 5,257,567

[45] Date of Patent: Nov. 2, 1993

[54] SHEET CUTTING APPARATUS

[75] Inventors: Kris J. Walker, Webster; Lisa M. Schlachter, Rochester; Eugene J. Manno, Ontario, all of N.Y.

[73] Assignee: Xerox Corporation, Stamford, Conn.

[21] Appl. No.: 888,948

[22] Filed: May 26, 1992

[51] Int. Cl.[5] ..... B26D 5/00

[52] U.S. Cl. ..... 83/74; 83/334; 83/349; 83/509; 83/650; 355/310

[58] Field of Search ..... 83/72, 74, 76, 334, 83/335, 349, 509, 650; 355/310, 323

[56] References Cited

U.S. PATENT DOCUMENTS

| | | | |
|---|---|---|---|
| 3,645,157 | 2/1972 | Di Giulio et al. | 355/310 |
| 3,727,499 | 4/1973 | Boston | 355/310 |
| 3,879,123 | 4/1975 | Fisher | 355/14 |
| 4,020,722 | 5/1977 | Byrt et al. | 83/74 |
| 4,058,037 | 11/1977 | Tashiro et al. | 83/70 |
| 4,104,723 | 8/1978 | Tokuno et al. | 83/74 |
| 4,224,848 | 9/1980 | Beerenwinkel | 83/76 |
| 4,464,959 | 8/1984 | Larson | 83/334 |
| 4,478,119 | 10/1984 | Larson | 83/74 |
| 4,635,511 | 1/1987 | Shirasu | 83/74 |
| 4,821,974 | 4/1989 | Poehlein | 242/68 |
| 4,885,613 | 12/1989 | Kudoh | 355/310 |
| 4,996,556 | 2/1991 | Gray, Jr. | 355/50 |
| 5,040,777 | 8/1991 | Bell et al. | 271/3 |

*Primary Examiner*—Scott Smith

[57] ABSTRACT

A sheet cutting apparatus is provided for cutting sheets from one or more media supply rolls. A rotary cutter bar cooperates with a stationary bar to sever the media as it is fed between the two bars. The rotary cutter bar is driven by a motor whose output is monitored by a speed control circuit. During a cut cycle, the motor speed may decrease with an increasing load caused, for example, by a thicker weight media being cut. Uncorrected, the motor speed would decrease, causing a deviation in the straightness of the cut. The speed control circuit senses the changes from the normal speed of the motor during the cutting cycle and generates a feedback signal to the motor to raise the speed to the operation level.

5 Claims, 10 Drawing Sheets

CONTROL PANEL

SHEET CUTTING APPARATUS

The invention relates to a sheet cutting apparatus and, more particularly, to an improved apparatus for supplying on demand cut sheets of various media and of selected sizes.

Copying relatively large size documents such as engineering drawings and the like normally requires that the copy sheet material be supplied from a roll assembly. As a result, it is necessary that the sheet material be cut to size from the roll being used, and for this purpose, a cut sheet roll supply is desirable. Typically, a cut sheet roll supply of the type referred to herein includes a roll support which holds and permits the roll to be unwound as sheets are cut therefrom, and a sheet cutter such as a rotary cutter which cuts or severs the sheet material in two. Also conventional is a document handling apparatus for unwinding the sheet material from the supply roll and advancing a length selected to the sheet cutter, and a machine control system for integrating and synchronizing operation of the various components. It is especially desirable that the sheet cutter be able to cut, with the utmost reliability and accuracy, a wide range of sheet material such as bond, vellum, film, tracing paper and the like in addition to a wide range of paper weights. However, prior art rotary bar type cutters (see, for example, U.S. Pat. Nos. 4,058,037 and 3,879,123, both of whose contents are hereby incorporated by reference) have a major disadvantage in that the rotary cutter bar may change speed while cutting sheet material because of changes in the mechanical load, the change in speed resulting in a variation in the straightness of the cut edge. Factors which vary the mechanical load, in addition to the nature of the media and its weight, include rotary cutter bar wear and media width and system contamination. All of these factors may provide unwanted rotary cutter speed variations during the actual cut operation. FIG. 1 is a graph of rotary cutter bar speed in rpm versus cut shear accuracy (straightness) in mm plotted at a process speed (movement of media through cutter station) of 3 inches/-second. To illustrate the problem, it is seen that, for example, if the cutter bar speed decreases from 80 rpm to 60 rpm during a cutting operation, cut skew accuracy changes by 4 mm.

According to one aspect of the present invention, the cutting speed of a rotary bar cutter is controlled by a closed loop circuit, which senses changes in cutter motor speed caused by any of a combination of the above factors and adjusts the motor speed to maintain the desired cutting speed. The control circuit is also adapted to enable detection of system fault conditions and to incorporate an electronic braking circuit which accurately home the cutting bar. More particularly, the present invention relates to a sheet cutting apparatus for cutting sheets being fed from a rolled output media into the transfer station of a document copier comprising, in combination:

a rotary cutter bar mechanism periodically activated to move in and out of cutting relationship during a cutting cycle with a media being fed therethrough, said mechanism including a stationary bar and a rotary cutter bar, and a drive motor for driving said rotary bar at a predetermined velocity, and speed control circuit means for monitoring the rotational speed of said motor and for detecting changes in motor speed during a cutting cycle and for generating control signals via a feedback loop to said motor to restore said motor speed to said predetermined speed during said cutting cycle.

The cutting apparatus described herein can operate by itself as a means to sever individual sheets from a web material or, in the alternative, can be employed as a component of a larger system wherein web material is cut into individual sheets before being fed into a copier system. Since the invention adapts itself very well to supply individual sheets to a large document copier system, it is described within this environment.

Figure 2:
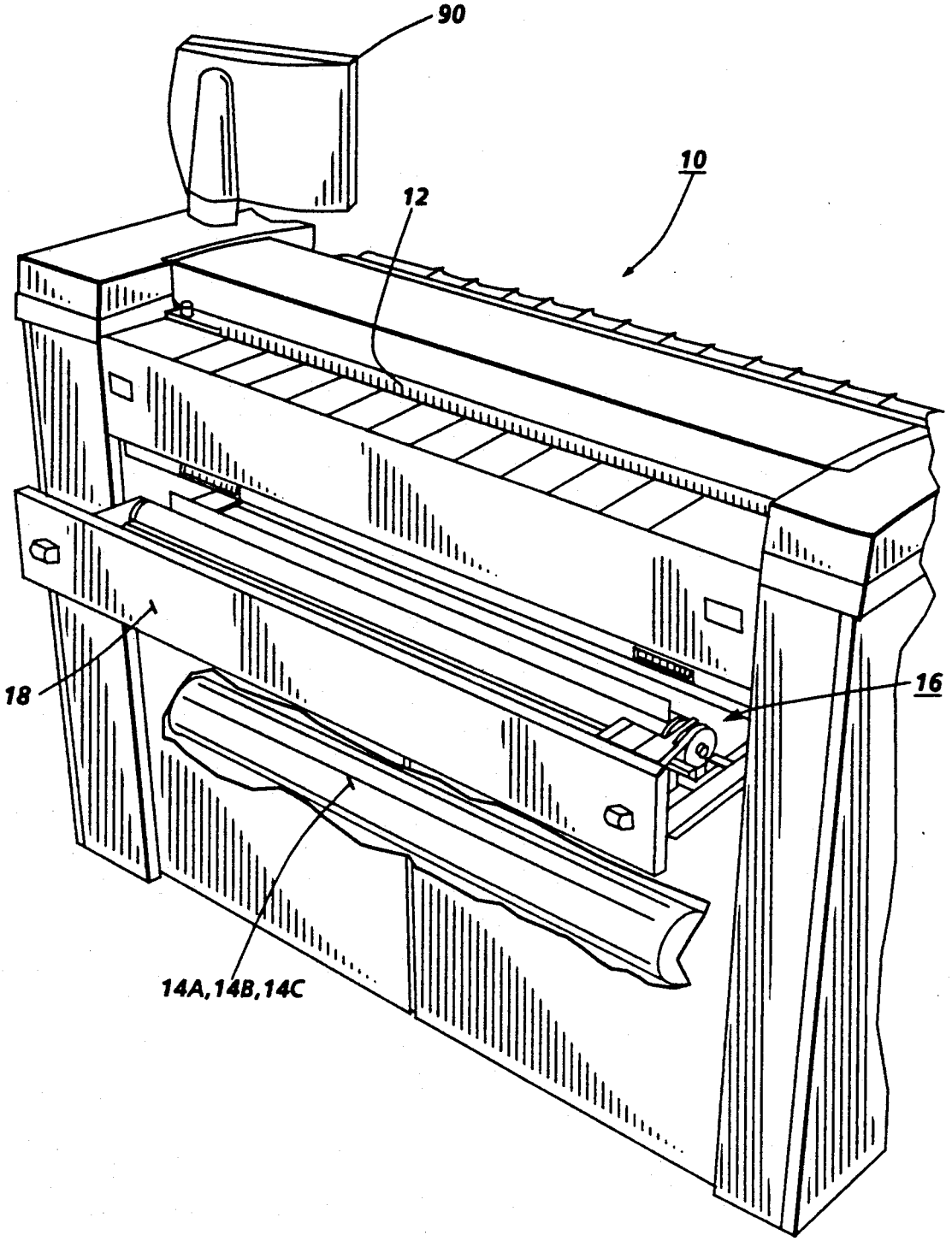
FIG. 2 is a perspective view of a large document copier incorporating the sheet cutter apparatus of the present invention.

Referring to FIG. 2, there is shown in rear view perspective, a large document copier 10. Documents to be copied are fed in from the front of the machine, pass through an exposure zone and exit via slot 12. A sheet roll support assembly 14 is located towards the base of the machine, where three roll assemblies, 14A, 14B, and 14C (FIG. 3) are located. The sheet media is fed upwards from the selected roll assembly, to be engaged by cutter assembly 16, located in cutter assembly drawer 18, shown in the open position.

Figure 3:
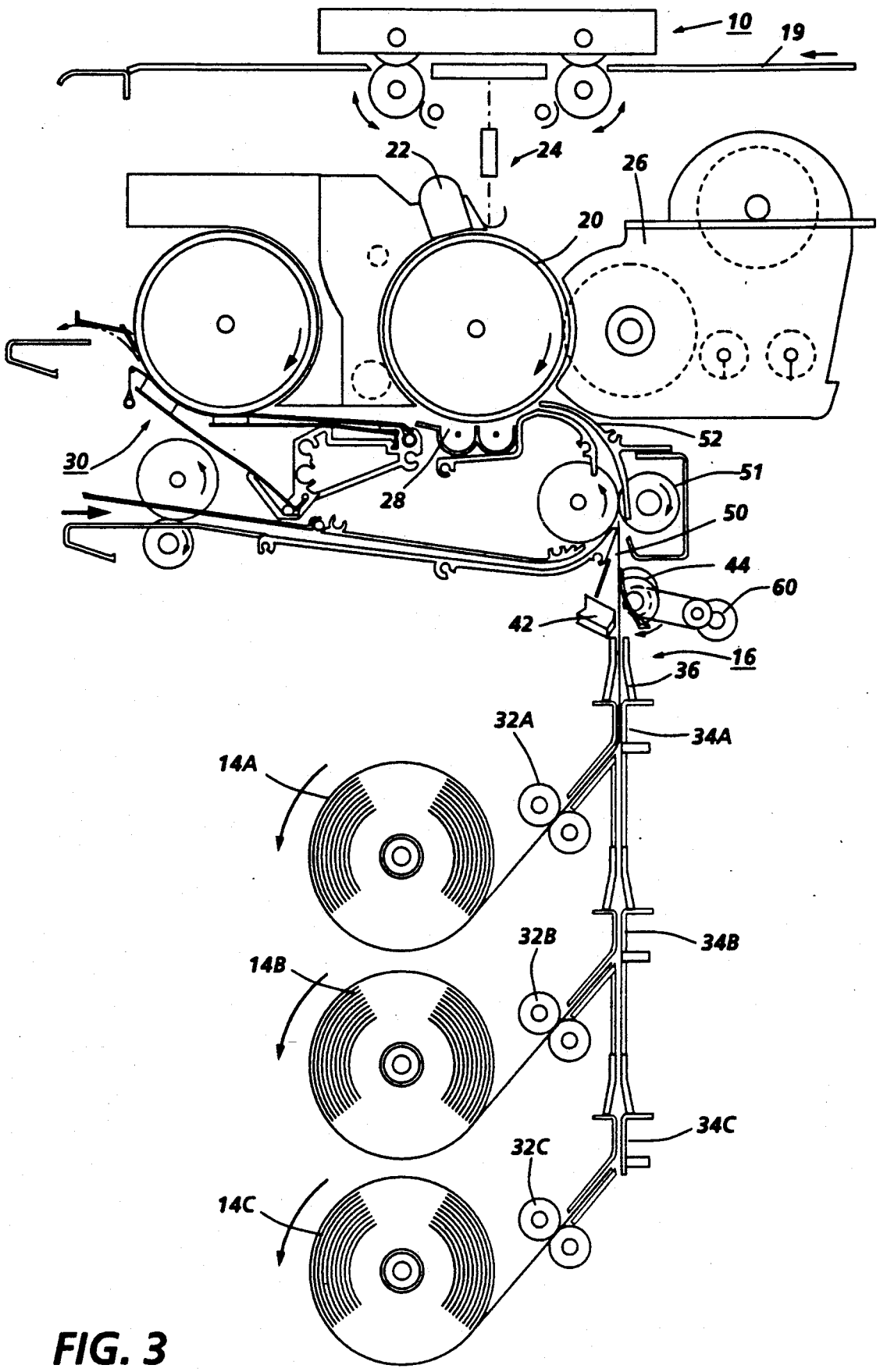
FIG. 3 is a side schematic view of the copier of FIG. 2.

FIG. 3 shows a side internal view of the copier 10. Copier 190 includes an electrostatic drum with xerographic stations arranged about its periphery, which carry out the operational steps of the copying process. These stations include charging station 22, exposure station 24, developing station 26, transfer station 28, and fusing station 30. Documents fed along the platen 10 in the direction of the arrow are imaged onto the surface of drum 20, at exposure station 24. The operations of the stations are conventional and are described, for example, in U.S. Pat. Nos. 4,821,974, 4,996,556 and 5,040,777, whose contents are hereby incorporated by reference.

Figure 4:
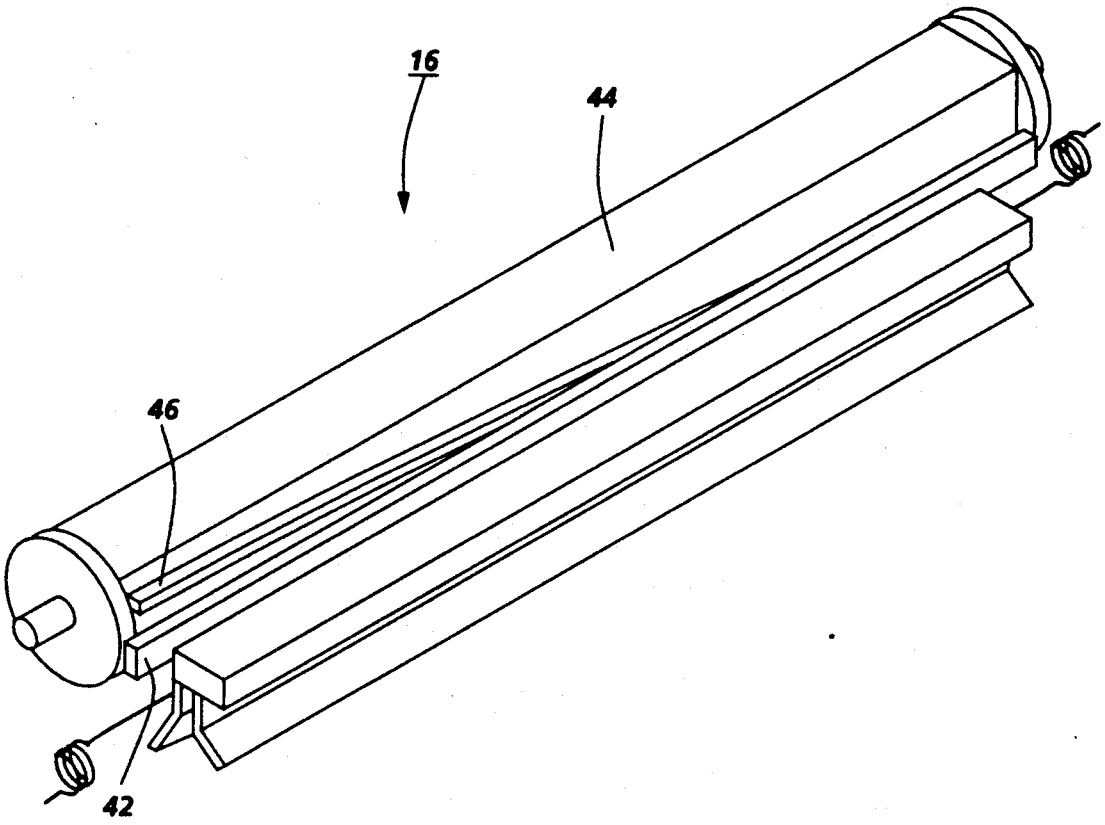
FIG. 4 is a top view of the sheet cutting apparatus.
Figure 5:
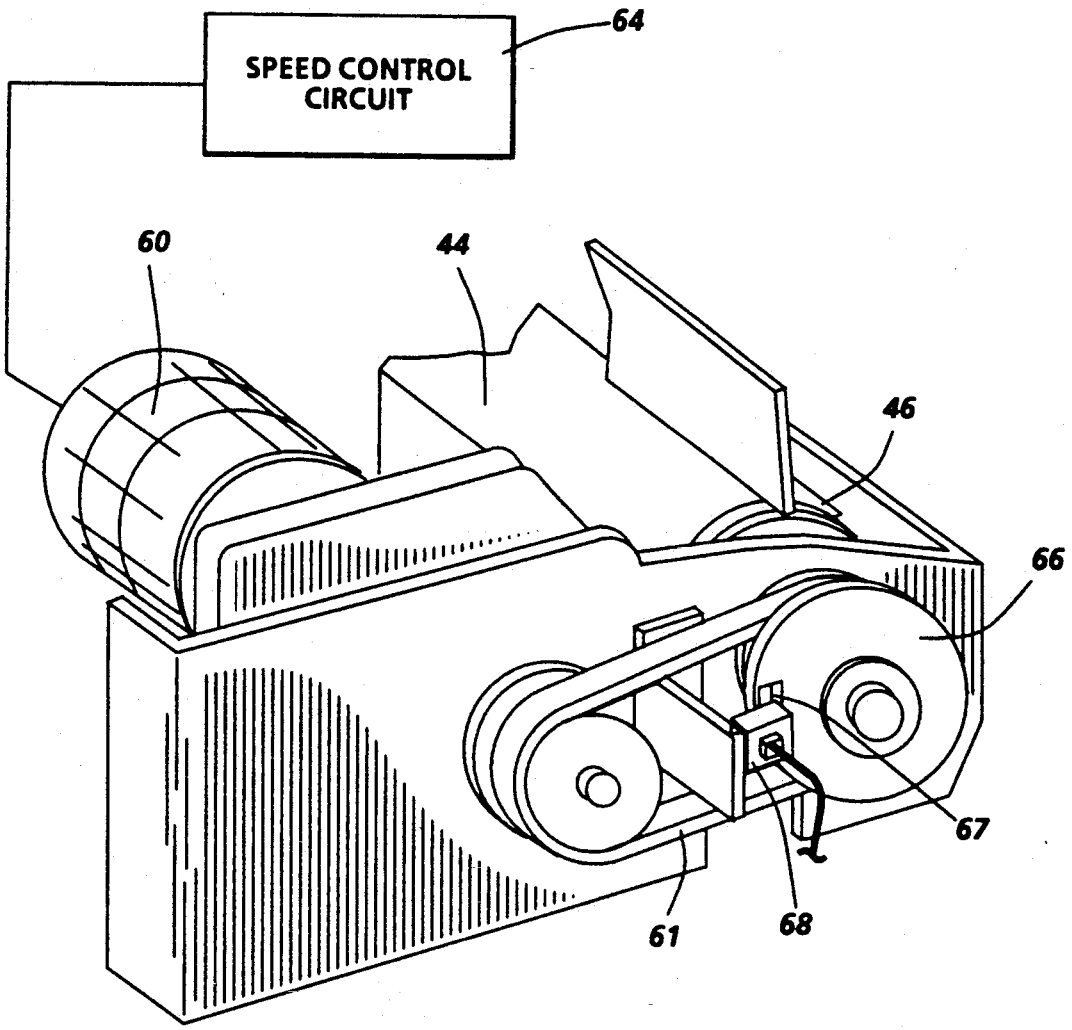
FIG. 5 is a side view of the sheet cutting apparatus.
Figure 6:
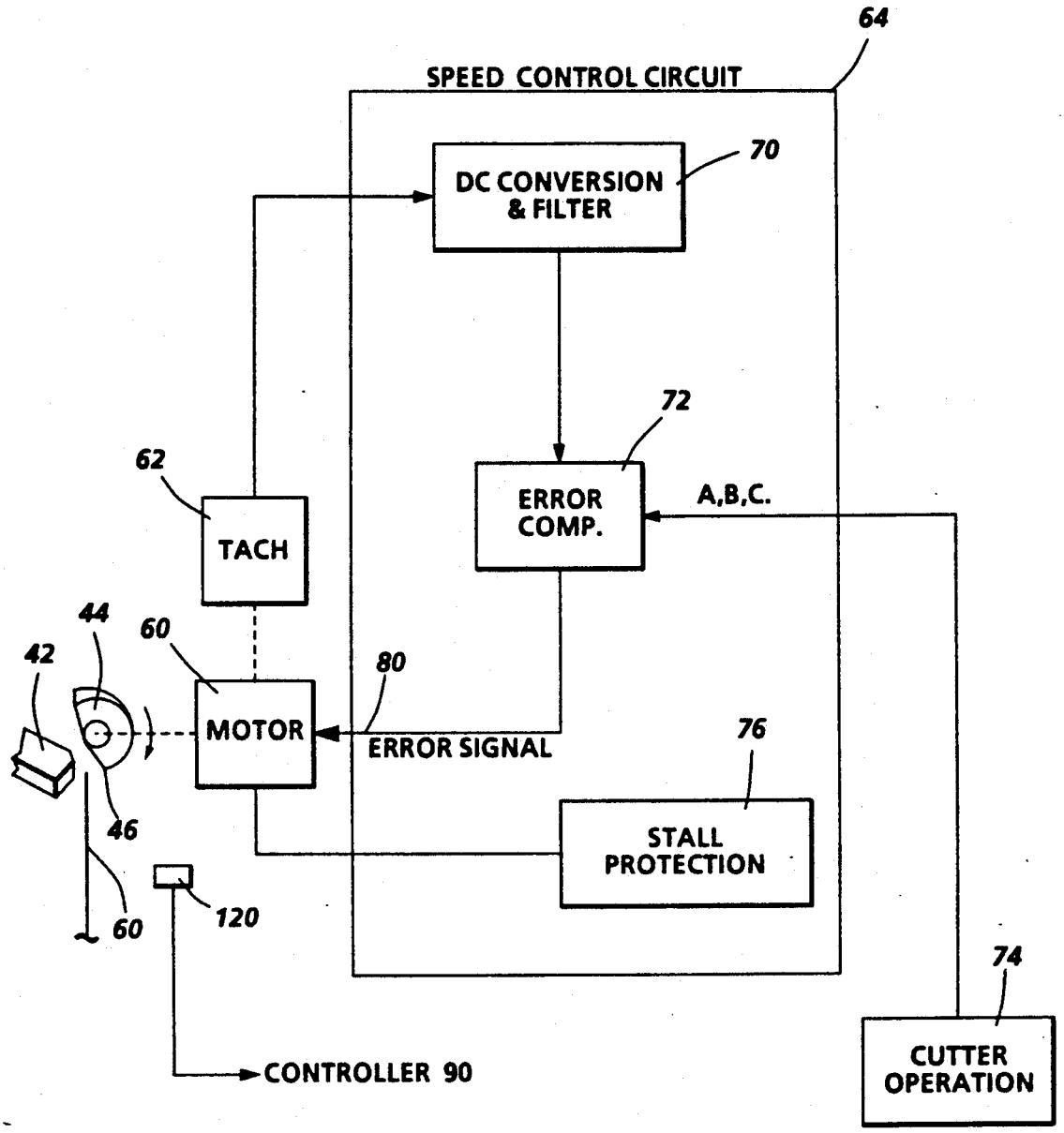
FIG. 6 is a block diagram of the speed control circuit shown in FIG. 2.

A copy media, which may be bond paper, vellum, or the like, is cut from the selected media roll support assembly 14A, 14B, 14C, and is fed therefrom by a feed roller pair 32A, 32B, 32C, respectively between sheet guides 34A, 34B, 34C. The sheet to be cut is guided along a vertical path between baffle pairs into the sheet cutting bar station. The sheet cutter assembly 16, shown removed in FIG. 4, comprises a stationary blade 42 and a rotating cutter bar 44, having a helical cutting blade 46. Cutter bar 44 is shown is shown, in FIG. 3, in the home position, which is about 30° of rotation away from the cutting position. Cutter assembly 16 is of the type described, for example, in U.S. Pat. No. 4,058,037, referenced supra. Initiated by a cutter operation signal, bar 44 rotates in the direction of the arrow with blade 46 moving against blade 42 to sheer the sheet with a straght cut. A cut sheet 50 is transferred by roller pair 51 into baffle 52 and then into transfer station 28 where the developed image is transferred onto the cut sheet 50. The transferred image is then fed to fuser station 30. As shown in FIGS. 5 and 6, rotary cutter bar 44 is driven by a motor 60, via a drive belt 61. In a preferred embodiment, motor 60 is a DC servo motor. Motor 60 also contains a tachometer 62, which continually measures motor speed and supplies a reference speed signal to speed control circuit 64. Circuit 64 contains the logic elements to compare the measured motor velocity with a previously determined reference velocity to supply signals to motor 60 in a feedback loop, to adjust the motor speed, so that cutter bar 44 continuously cuts the sheets in a straight or square configuration. With further reference to FIG. 5, a cutter encoder disk 66, having encoder disk window 67, rotates with bar 44, and is used to monitor the position of the cutter bar, in cooperation with cutter bar home sensor 68, as will be seen.

Referring now to FIG. 6, rotary cutter 44 is driven by DC motor 60. The operating speed of the motor will be a function of the process speed of the system and the angle at which the cutter is operation. For this example, a process speed of 3 inches/sec. (ipm) and an inclination of 6.5 mm of the bar, with respect to a horizontal plane perpendicular to the vertical path through which the sheets is moving. The inclined position is required in order to obtain a perpendicular cut of the sheet. The motor speed has been set at 100 rpm. This operating speed will be controlled by a closed feedback loop enabled by speed control circuit 64 as will be seen. Motor tachometer 62 provides an output ac signal representing the motor speed. The output is sent to a dc conversion and filtering circuit 70 in speed control circuit 64. The dc signal from circuit 70 is then fed to an error compensation circuit 72. During the time in which the cutter bar is being rotated (as determiend by digital inputs applied by signals generated in cutter operation circuit 74), this signal is compared to a signal representing the operating speed (100 rpm). If an error is detected in error compensation circuit 72, an error signal is fed back to motor 60 adjusting the speed to rotate the motor at the desired operating speed. The motor is also protected by an electronic stall protection circuit 76.

Figure 1:
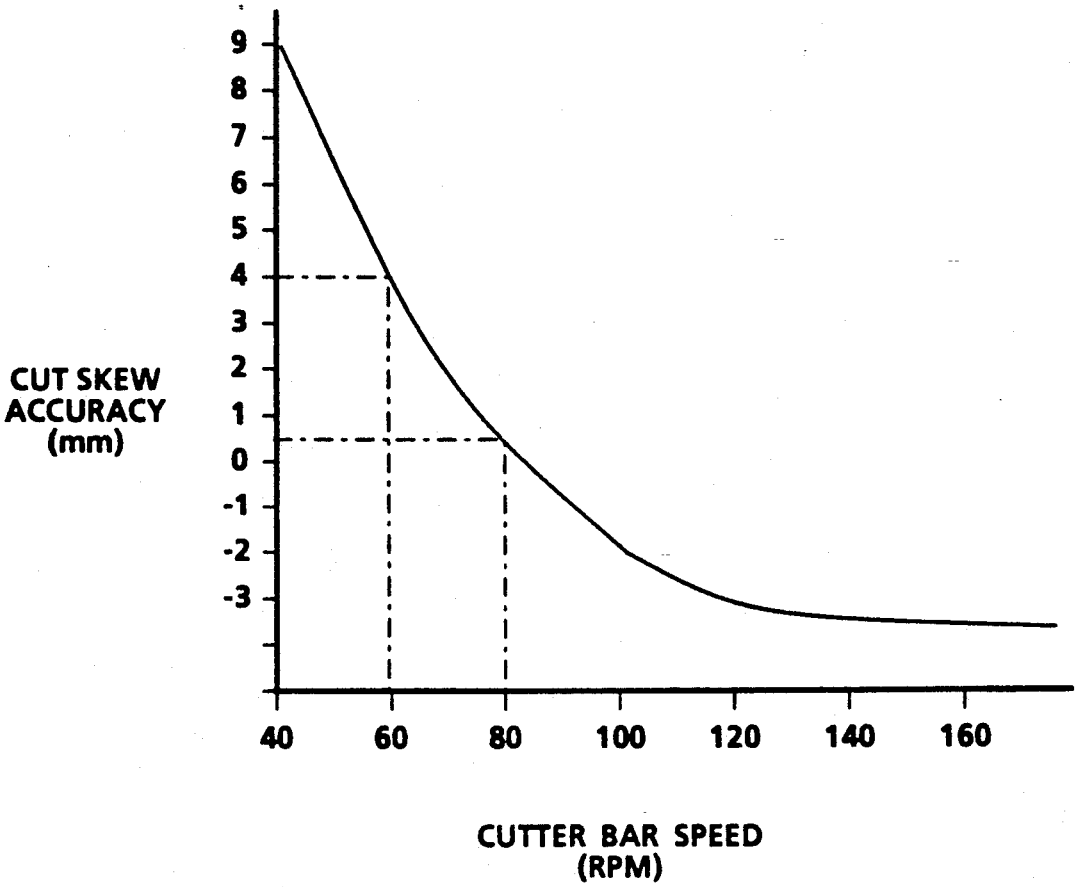
FIG. 1 shows a graph plotting cutter bar speed versus cut skew accuracy.
Figure 7:
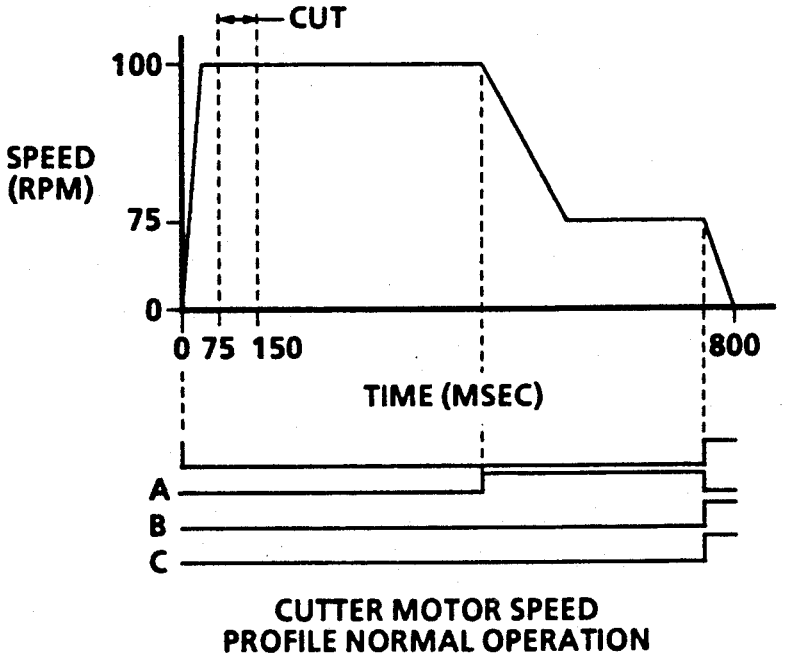
FIG. 7 is a plot of the cutter motor speed over time as controlled by three digital input signals.
Figure 8A:
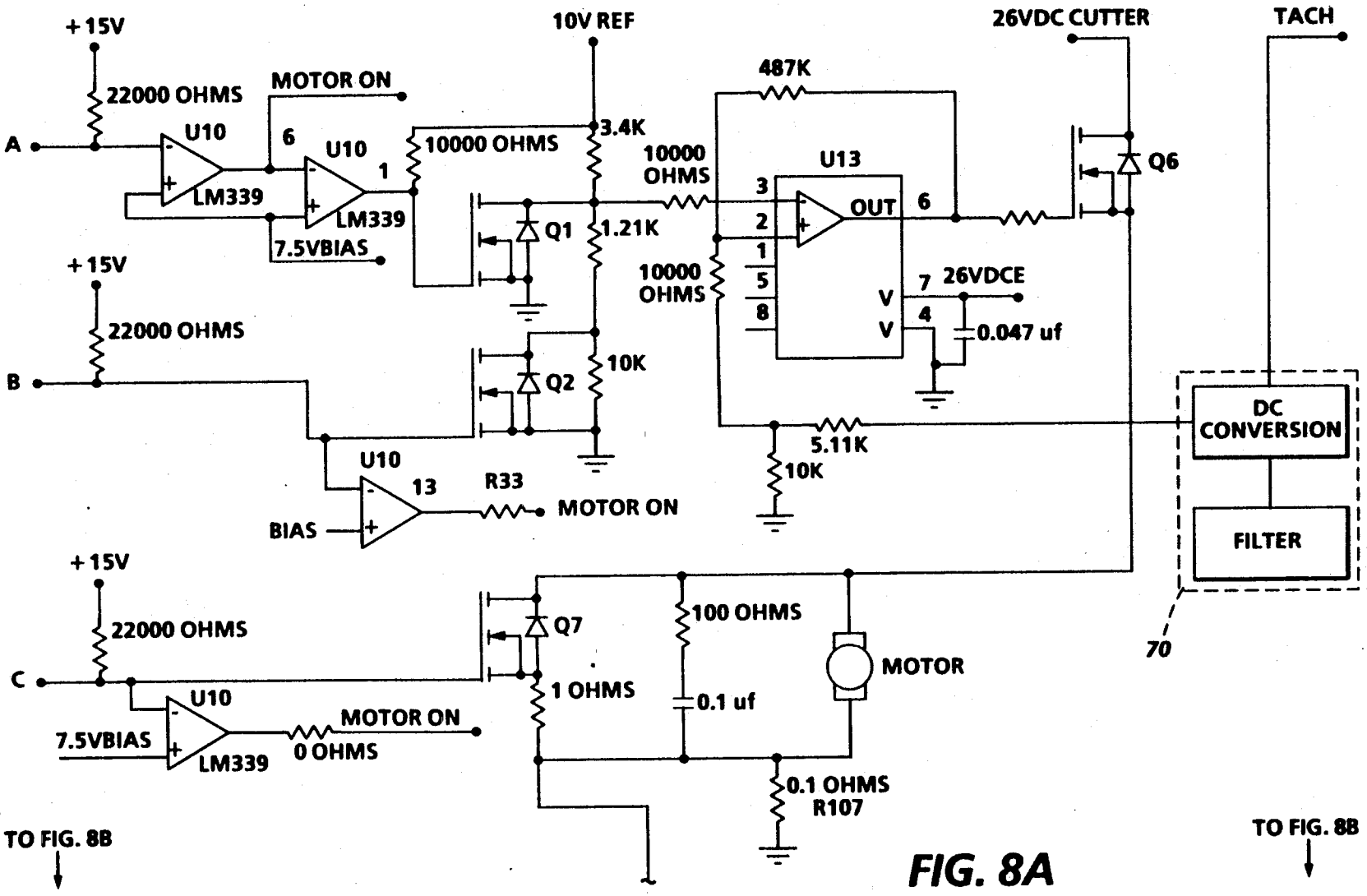
FIG. 8A and 8B is a detailed circuit diagram of the block diagram of FIG. 3.
Figure 8B:
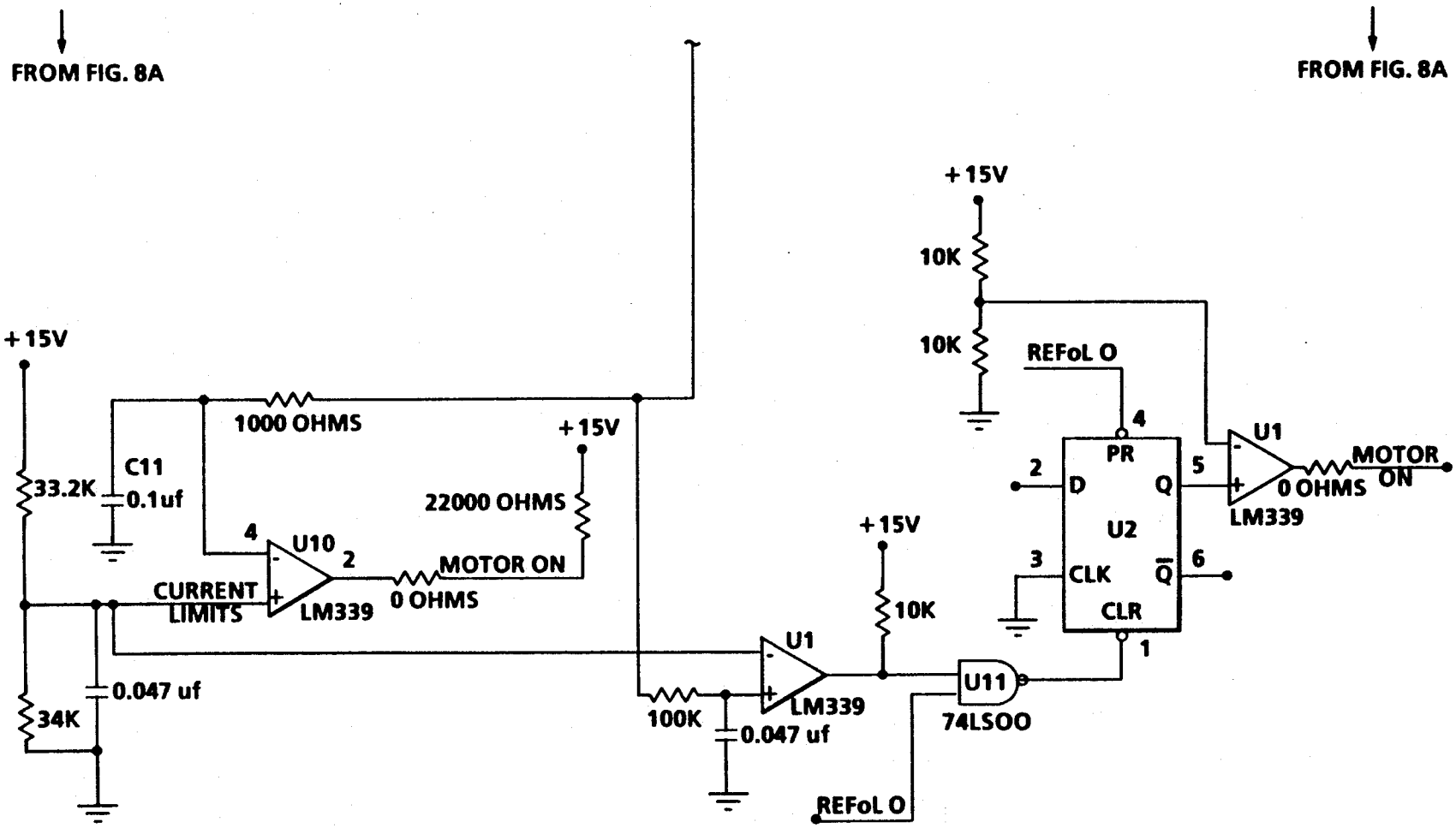

Considering next FIGS. 7 and 8A, 8B, FIG. 7 is a profile of the motor 60 speed during a cut cycle; FIG. 8A, 8B is a more detailed schematic of the speed control circuit 64.

A cut cycle begins with signals A, B. and C, all low; transistor Q1 and Q2 both off, and transistor Q6 turning on allowing current to flow through motor 60. The motor rotates up to speed and is then controlled upon that point. As shown in FIG. 7, the motor attains cutting speed of 100 rpm in about 35 msec. and the bar 44 is rotated 30° clockwise into the cutting cycle at about 75 msec. The actual cutting time of the sheet of paper takes place within the 75–150 msec. time period. During the actual cut time, the system load may change due to the facts discussed earlier. For example, if the media being cut is a heavy vellum, the motor speed would tend to decrease as it cuts through the relatively heavier vellum medium. This decrease is immediately compensated for by the feedback loop extending from tachometer 62 through circuit 70, 72 and back to pin 2 of U13. The gate of transistor Q6 is then driven to increase the motor current via feedback error signal line 80 and restore the motor speed to the 100 rpm operating speed.

Following the cut cycle, the motor continues to run at the 100 rpm speed until signal B is switched high, turning transistor Q2 on and setting the lower reference voltage at pin 3 of U13. The gate voltage of Q6 is cut back until motor 60 slows down to a lower speed of about 25 rpm, and is then controlled for a short term around this new reference. At the end of the cut cycle, signal A is switched high, turning Q6 off. Signal C is switched high, turning on transistor Q7, causing the motor to break and return to the home position, after approximately 800 msec.

Feedback for stall protection is provided by sense resistor R107. Full motor current flows through R107. Capacitor C11 is charged and compared to pin 4 of amplifier U10. If the motor current is greater than 7 amps for 0.5 msec., U10 pin 2 switches low. This is tied to U10, pin 6 and forces U10, pin 1 high, turning on Q1 and turning off Q6, shutting off the motor current.

The controls are protected from U10 and Q6 being on at the same time, which would short out the 26 dc power supply. With signal C high, U10, pn 13, is low, U10, pin 6 is low, U10, pin 1 is high, even if signal A is low, Q1 is on and Q6 is off.

Figure 9:
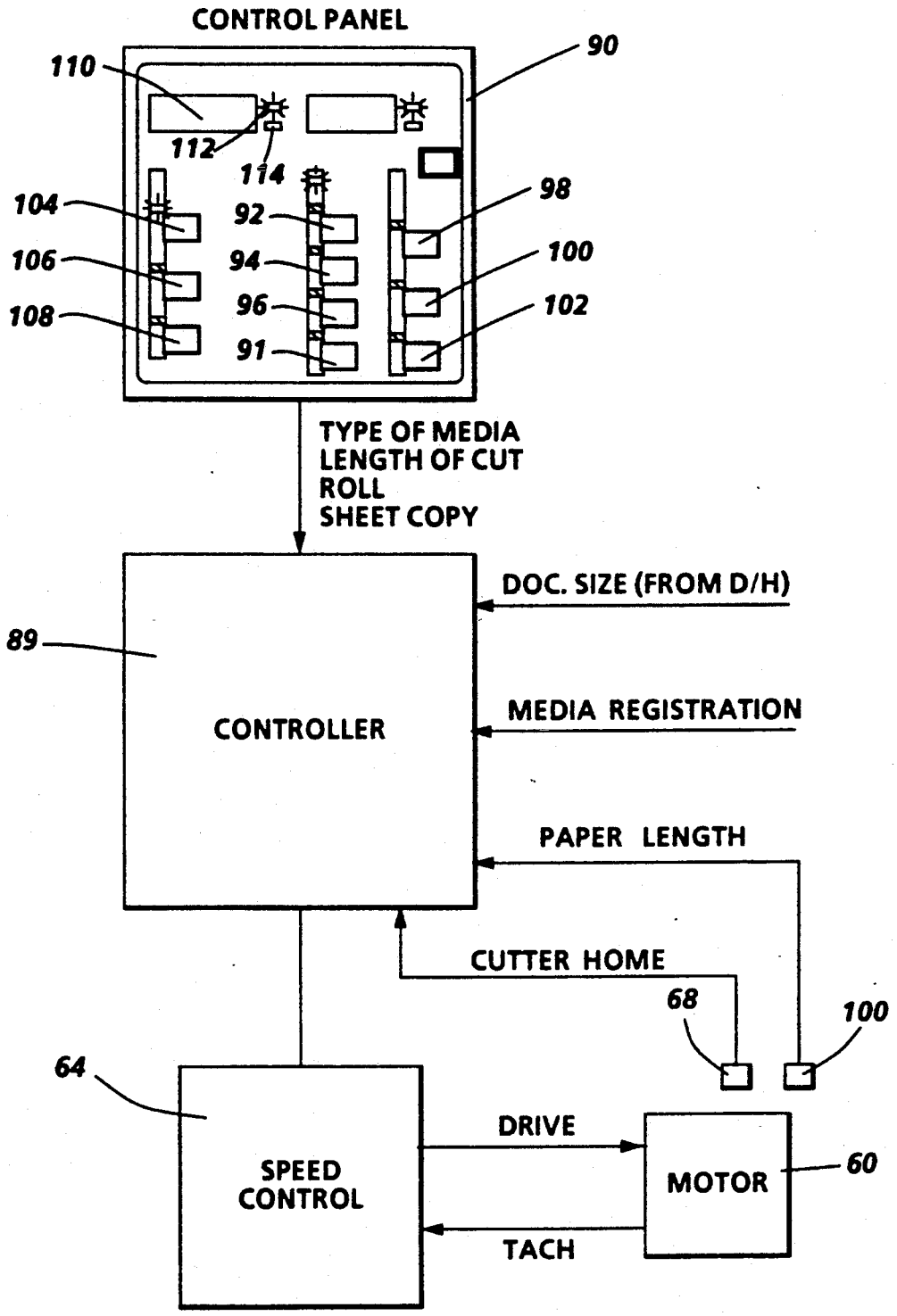
FIG. 9 is an operational diagram illustrating selection of the cut sheet options from a control panel.

Referring now to FIG. 9, a suitable controller 89 is provided for controlling operation of assembly 16, in response to program instructions input by the operator or user, control panel 90 being provided for this purpose. Controller 89 controls and synchronizes operation of drive motor 60, via speed control circuit 64, in accordance with program instructions from control panel 90. Controller 89 may be of the type disclosed in U.S. Pat. No. 4,996,556, referenced supra. To enable the length of the cut sheet to be selected, panel 90 is provided with a suitable media length selector which permits the operator to select the length of the sheet to be cut.

Figure 10:
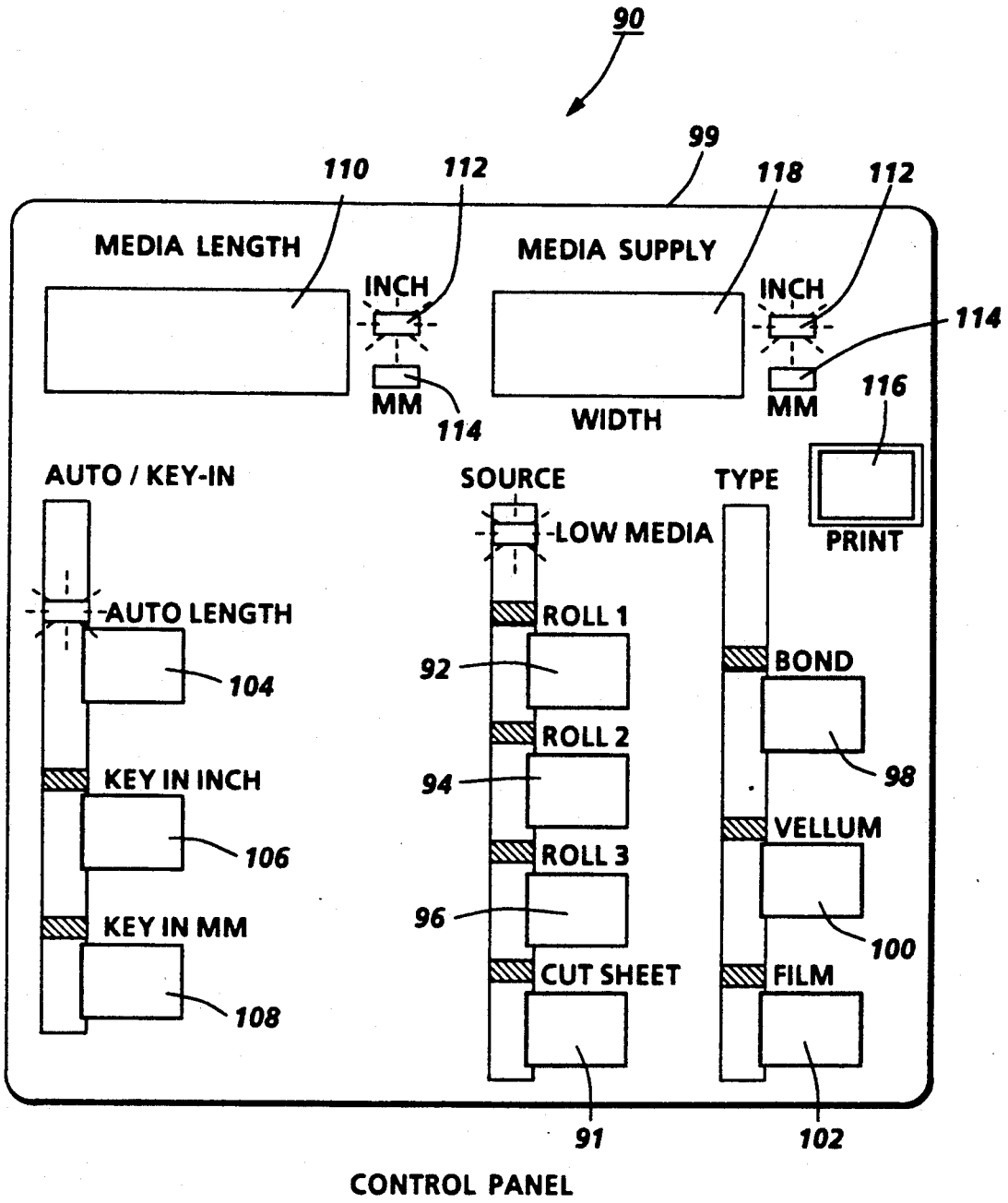
FIG. 10 is an enlarged view of the control panel which controls selection of the cutting choices.

Referring to FIGS. 9 and 10, the cutting mode is initiated by depressing the cut sheet button 91. Roll 14A, 14B, 14C, is selected by depressing the appropriate button 92, 94, 96, respectively. Roll 1 (button 90) is the default selection. Upon activation of the cut sheet button 91, the "Media type" buttons 98, 100, 102, associated with bond, vellum and film respectively, begin to alternately flash until the operator makes the appropriate selection. The operator next determines whether the media will be automatically cut to the input document length or cut to a particular set length. The former option is enabled by depressing the Auto-Length button 104 (this is also the default option). When the Key in inch button 106 or the Key is mm button 108 is depressed, the Media Length display 110 shows the length selected. The inch or mm displays 112, 114, next to display 110, as illuminated, depending on the selection of buttons 106, 108. These selections are entered into controller 89 memory along with information on document size from a document handler (not shown) and media registration from roll sensors. Upon depression of the PRINT button 116, the copy cycle is initiated. Referring to FIG. 2, the original document is fed into the exposure zone; if the auto length selection at key 104 has been depressed, the document length is sensed by, for example, the techniques disclosed in U.S. Pat. Nos. 4,996,556 and 5,040,777, whose contents are hereby incorporated by reference. A signal representing the document length is sent to controller 89 to provide the timing information which will constitute the input signals to the speed control circuit 76, If a key in signal has been generated, controller 89 will automatically send the cut signal at the appropriate time. A suitable device such as a encoder 120 (FIG. 6) monitors the length of the sheet material fed from the cutter mechanism, the signal output of encoder 120 being input to controller 89. Controller 89 terminates feeding of the sheet material from the selected supply roll when the length of the sheet material fed to the cutter mechanism equals the length programmed for processing. Under control of controller 89, sheet material from the selected feed roll is advanced into the cutting zone. The sheet material will be held there until the "cut" signal is generated by controller 89. Bar 44 is then rotated and blade 46 makes a square cut as the paper passes between bar 44 and bar 42. Bar 44 continues to rotate, driven by motor 60, having the speed profile shown in FIG. 7. During the actual cutting cycle, the speed control circuit 64 will adjust the speed of the motor, in response to changes in system load, due to the media resistance, increased bar wear, or the like. The cutter bar continues to rotate after cutting the sheet, making one complete revolution. The cutter home sensor 68 detects the encoder disk window 67 (FIG. 5) and sends a signal to controller 80, stopping motor 60 rotation. The cut sheet advances through the transfer station 28 where the developed image is transferred, and then fused at the fusing station 30. If no additional copies are to be made, the paper is retracted onto the selected roll. If additional copies are to be made on the same roll, the media will continue to advance along the paper path until the next cut signal arrives.

While the invention has been described with reference to the structures disclosed, it is not confined to the details set forth, but is intended to cover such modifications or changes as they come within the scope of the following claims.

What is claimed is:

1. A sheet cutting apparatus for cutting sheets being fed from a rolled output media into the transfer station of a document reproduction machine comprising, in combination:

a rotary cutter bar mechanism peridocially activated to cut a copy sheet media during a predetermined cutting period within a cutting cycle and a predetermined cutting speed, said mechanism including a stationary bar, a rotary cutter bar and a drive motor rotating at a rotational speed to drive said rotary bar at said predetermined cutting speed; and speed control circuit means for monitoring the rotational speed of said drive motor and for detecting changes in motor rotational speed during said cutting period and for generating control signals via a feedback loop to said motor to adjust said motor speed so that said predetermined cutting speed is maintained during said cutting period.

2. An apparatus according to claim 1 and further including means for selecting the length of the copy sheet media to be cut by the sheet cutting apparatus.

3. The apparatus of claim 1 wherein said copy sheet media is fed from one of a plurality of roll supplies and wherein said speed control circuit means includes means for selecting one of said roll supplies.

4. In a document reproduction machine wherein documents are imaged onto a photosensitive medium to form a latent image and wherein said latent image is developed and transferred to an output sheet, a mechanism for severing said output sheet from an unwinding sheet supply roll, including:

rotary cutter bar means periodically activated during a cutting cycle to rotate at a constant rotational speed during said cycle to cut across an output sheet supply during a predetermined cutting period to form a straight edge cut, and circuit means adapted to maintain a constant rotational speed during said cutting period, and wherein said rotary cutter bar means includes:

a rotary cutter bar mechanism periodically activated to cut a copy sheet media during said predetermined cutting period and at a predetermined cutting speed, said mechanism including a stationary bar, a rotary cutter bar and a drive motor rotating at a rotational speed to drive said rotary bar at said predetermined cutting speed, and speed control circuit means for monitoring the rotational speed of said drive motor and for detecting changes in motor rotational speed during said cutting period and for generating control signals via a feedback loop to said motor to adjust said motor speed so that said predetermined cutting speed is maintained during said cutting period.

5. The apparatus of claim 1 wherein said rotary cutter bar mechanism is inclined at an angle with respect to a horizontal line drawn through said vertical plane.

* * * * *